US008033214B2

(12) United States Patent
Neubrand et al.

(10) Patent No.: US 8,033,214 B2
(45) Date of Patent: Oct. 11, 2011

(54) DEVICE FOR DELIVERING THICK MATTER

(75) Inventors: Klaus Neubrand, Ostfildern (DE); Klemens Finsterwalder, Bernau (DE)

(73) Assignee: Putzmeister Solid Pumps GmbH, Aichtal (DE)

( * ) Notice: Subject to any disclaimer, the term of this patent is extended or adjusted under 35 U.S.C. 154(b) by 518 days.

(21) Appl. No.: 12/064,714

(22) PCT Filed: Aug. 9, 2006

(86) PCT No.: PCT/EP2006/007868

§ 371 (c)(1),
(2), (4) Date: May 9, 2008

(87) PCT Pub. No.: WO2007/022867

PCT Pub. Date: Mar. 1, 2007

(65) Prior Publication Data

US 2008/0219870 A1 Sep. 11, 2008

(30) Foreign Application Priority Data

Aug. 23, 2005 (DE) ..... 10 2005 040 014

(51) Int. Cl.
*B30B 9/06* (2006.01)

(52) U.S. Cl. ..... 100/126; 100/50; 100/215; 210/770

(58) Field of Classification Search ..... 100/43, 100/45, 50, 92, 104, 112, 116, 126, 215, 100/240, 245, 906; 210/770
See application file for complete search history.

(56) References Cited

U.S. PATENT DOCUMENTS 1,135,309 A 4/1915 Meakin
2,159,258 A 5/1939 de la Roza, Sr.
2,705,916 A * 4/1955 Millgard ..... 100/95
3,021,254 A 2/1962 Helversen et al.
3,168,033 A 2/1965 Hansen
3,471,203 A 10/1969 Schlecht et al.
4,198,904 A * 4/1980 Cheale et al. ..... 100/45
4,343,233 A * 8/1982 Burgin ..... 100/116

(Continued)

FOREIGN PATENT DOCUMENTS

CN 2483526 Y 3/2002

(Continued)

*Primary Examiner* — Jimmy T Nguyen
(74) *Attorney, Agent, or Firm* — Leydig, Voit & Mayer, Ltd.

(57) ABSTRACT

The invention relates to a device for delivering thick matter. The device comprises: a delivery cylinder (20); a material feed space (16), which is connected to the delivery cylinder (20) on the entry side; a delivery line (18), which is connected to the delivery cylinder (20) on the exit side; a delivery plunger (12), which can be displaced to-and-fro through the material feed space (16) and the delivery cylinder (20), and; a closing element (22), which is placed at the exit location of the delivery cylinder (20) or inside the delivery line (18) and which can be displaced between an open position and a closing position. In order to be able to separate foreign substances, which are contained in the flow of thick matter, out of the flow of thick matter before the actual processing step for the useful substances, the invention provides that the delivery cylinder (20) is perforated at least over a portion of its cylinder jacket (24). These measures make it possible to obtain a device that combines the features of a thick matter pump, a sieve and a press.

22 Claims, 3 Drawing Sheets

U.S. PATENT DOCUMENTS

| | | | | |
|---|---|---|---|---|
| 4,603,909 | A * | 8/1986 | Le Jeune | 299/7 |
| 5,347,921 | A * | 9/1994 | Gourdol | 100/98 B |
| 5,630,362 | A | 5/1997 | Jonsson et al. | |
| 5,875,707 | A * | 3/1999 | Rajala | 100/37 |
| 5,988,028 | A | 11/1999 | Schlecht et al. | |
| 7,383,766 | B2 * | 6/2008 | McIntosh et al. | 100/92 |

FOREIGN PATENT DOCUMENTS

| | | | |
|---|---|---|---|
| DE | 1502151 | | 5/1969 |
| DE | 1941003 | | 2/1971 |
| DE | 3113515 | A1 * | 11/1982 |
| DE | 19524048 | | 1/1997 |
| DE | 10256674 | | 6/2004 |
| EP | 0673305 | | 9/1995 |
| EP | 0681672 | | 11/1995 |
| GB | 1220173 | | 1/1971 |
| GB | 2200928 | | 8/1988 |
| GB | 2282337 | | 4/1995 |

* cited by examiner

DEVICE FOR DELIVERING THICK MATTER

This is a U.S. national phase application under 35 U.S.C. §371 of International Patent Application No. PCT/EP2006/007868, filed Aug. 9, 2006, and claims benefit of German Patent Application No. 10 2005 040 014.0, filed Aug. 23, 2005. The International Application was published in German on Mar. 1, 2007 as WO 2007/022867 under PCT Article 21(2).

The present invention relates to a device for conveying thick matter, including a delivery cylinder, a material feed space connected to the inlet side of the delivery cylinder, a delivery line connected to the outlet side of the delivery cylinder, a delivery piston which is reciprocatable through the material feed space and the delivery cylinder, and further including a closure member which is located at the outlet side of the delivery cylinder or in the delivery line and is movable between an open position and a closed position.

BACKGROUND

European Patent EP-B 681672 describes a device which is designed for conveying thick matter containing shredded scrap metal. In that device, the thick matter is fed to the delivery device via the material feed space and is moved by the delivery piston into the delivery cylinder, from where it is forced through the delivery line. The closure member provides that, during each stroke, the thick matter is first compressed in the delivery cylinder before it is forced into the delivery line while the closure member is open. This device conveys the thick matter through the delivery conduit along with the foreign substances contained therein, including scrap metal and similar solids.

In principle, this device can also be used to convey biogenic wastes, which generally contain not only organic components, but also considerable amounts of foreign substances. The foreign substances must be removed from the material flow for a subsequent processing step. As long as the waste is in a relatively dry form, the separation of foreign substances is mostly done by hand. However, in the case of wet organic waste, the method chosen is that of shredding. In the treatment of food remains, for example, one uses hammer mills capable of shredding foreign substances, such as knife handles, to particles of less than 10 mm in size. Thick matter that is conditioned in this way can indeed be transported by a thick matter pump of the type specified at the outset. However, the disadvantage here is that the foreign substances are still contained in the material flow. The material separation problem is not solved in this manner, but shifted to a process step at the end of the transport process. This is the procedure used, for example, for food waste substrate which is fed to a fermenter and which still contains foreign substances such as shredded plastic packaging, cans, tubes, knives, forks. There, the organic matter is indeed degraded in the fermentation residue, but the shredded foreign substances contained in the sludge must still be removed if the sludge is intended for use as an organic nitrogen fertilizer. Without separation, the only possible method of disposal is by burning.

SUMMARY

In view of the above, it is an aspect of the present invention to improve a known device for conveying thick matter in such a way that the foreign substances are separated from the material flow before the actual processing step for the useful substances.

The present invention provides a device for conveying a mixture of substances including at least one mixture component predominantly having a viscous consistency and at least one mixture component predominantly having a solid, particle-like consistency. The invention includes a delivery cylinder having perforations over a portion of a lateral wall thereof and configured to separate, through the perforations, at least one of the mixture components from the mixture of substances. The delivery cylinder is connected, via a pipeline provided on an outside of the perforated lateral cylinder wall, to a processing station for the separated at least one mixture component. A material feed space is connected to an inlet side of the delivery cylinder. A delivery line is connected to an outlet side of the delivery cylinder. A delivery piston is reciprocatable through the material feed space and the delivery cylinder. A closure member is disposed at the outlet side of the delivery cylinder or in the delivery line and movable between an open position and a closed position.

BRIEF DESCRIPTION OF THE DRAWINGS

The present invention will be explained in more detail below with reference to an exemplary embodiment schematically shown in the drawing, in which.

DETAILED DESCRIPTION

Figure 1:
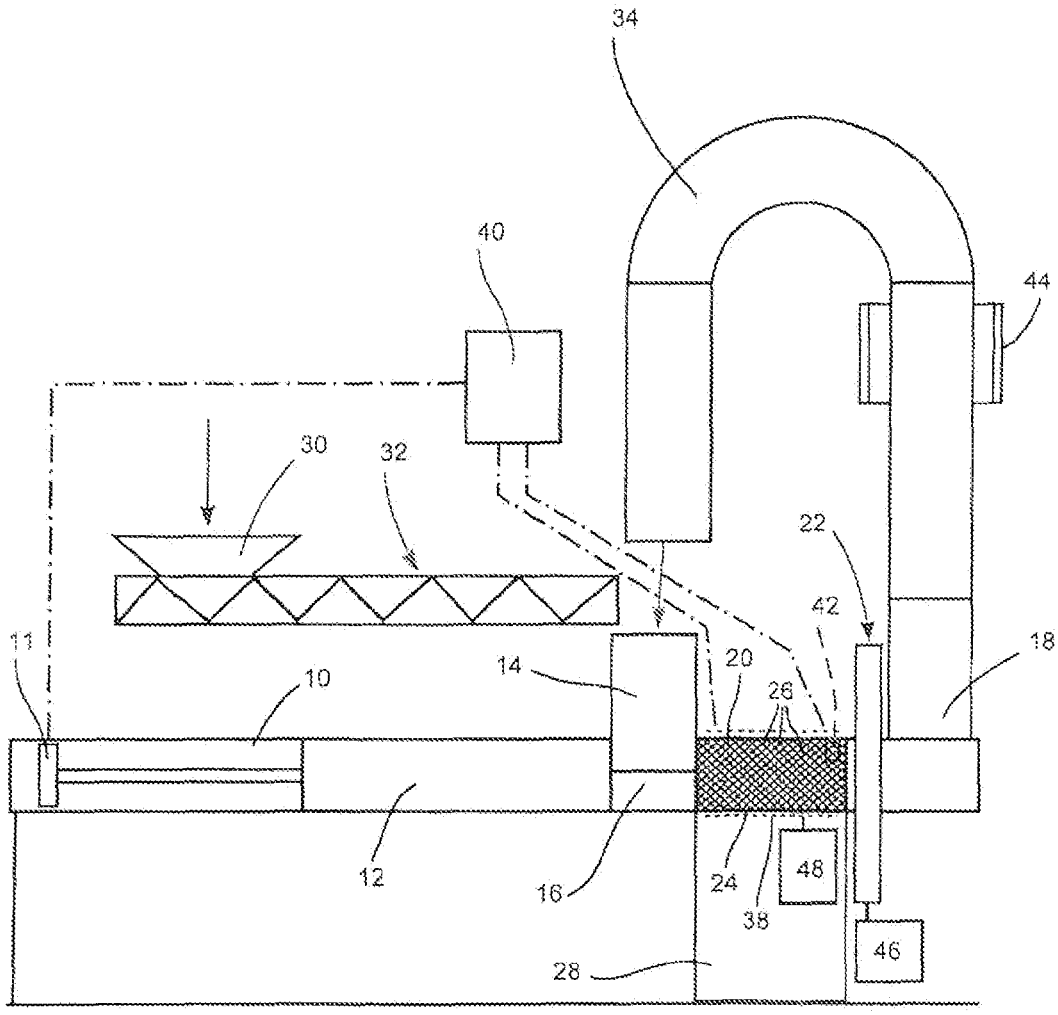
FIG. 1 is a schematic view of a single-piston pump for preparing and conveying biogenic wastes.

The present invention is based on the idea of developing a device that combines the features of a thick matter pump, a sieve and a press. In a device of the type specified at the outset, in order to achieve this, the delivery cylinder is perforated at least over a portion of its lateral wall. In this case, the device provides a press for the thick matter that is conveyed by the delivery piston from the material feed space into the delivery cylinder while the closure member is closed.

The perforated lateral cylinder wall constitutes a sieve unit through which the useful liquid substances are passed to the outside and into a collecting duct under the action of the pressure developed by the press. Subsequently, while the closure member is open, the foreign substances are forced into the delivery line in the manner of a pump.

In an advantageous embodiment of the present invention, the perforations of the lateral cylinder wall are in the form of a grid of holes. More specifically, the perforations are arranged in a portion of the lateral cylinder wall that is swept by the delivery piston during reciprocation. It has proven advantageous if the cross-sectional area of the holes forming the perforations is smaller on the inside than on the outside of the lateral wall. In order to prevent premature wear, the lateral wall of the delivery cylinder is expediently made from a material that is hardened on the inner side.

In a preferred embodiment of the present invention, a slide is disposed in the area of the lateral cylinder wall, said slide being movable relative to the lateral cylinder wall between a closed position, in which the perforations are sealed, and an open position, in which the perforations are left open.

Advantageously, the lateral cylinder wall is surrounded by a tubular slide. The slide is movable axially with respect to the lateral cylinder wall. In one advantageous embodiment of the present invention, the lateral cylinder wall is perforated over at most half its length, while the slide has a closed shell and is moved by half the length of the lateral cylinder wall from the open position to the closed position.

In principle, however, the slide may also have a grid of holes and closed areas therebetween, said grid being complementary to the grid of holes of the lateral cylinder wall. In this case, it is possible for the slide to be moved or rotated between the open position and the closed position in an axial or circumferential direction with respect to the lateral cylinder wall by half the grid spacing of the grid of holes. This results in a relatively small rotational or translational movement of the slide as compared to the embodiment where half the cylinder length is used.

In principle, it is also possible to use a sealing device having a separate sealing member for each perforation hole. Such a sealing member may, for example, be in the form of a plug or a sealing cone.

In another preferred embodiment of the present invention, a control unit is provided for coupled control of drive mechanisms for moving the piston, the closure member and/or the slide. In order to achieve this, the controller conveniently provides a sequence control system for controlling the drive units of the piston, of the closure member, and of the slide.

In this connection, it is advantageous if, in response to displacement signals produced by the piston, the control unit causes the closure member to perform a closing movement and/or if, in response to output signals of a pressure sensor located upstream of the closure member in the delivery cylinder or in the delivery line, the control unit causes the closure member to perform an opening movement.

Similarly, the slide may also have a drive mechanism that is controllable by the control unit. In this case, the control unit will respond, for example, to displacement signals of the delivery piston by causing the slide to perform an opening movement as the delivery piston moves into the delivery cylinder, while it will respond to a pressure signal of the pressure sensor by causing the slide to perform a closing movement when the pressure exceeds a predetermined threshold.

Advantageously, to ensure that the perforation holes are always open for the passage of the useful substances therethrough, a cleaning device is provided which applies compressed air or pressurized water to the perforation holes. Apart from that, clogging of the perforation holes with filter cake is also reliably prevented because the passing piston automatically cleans the cylinder surface during each stroke.

The pressure at which the closure member is opened can be adjusted by the piston travel and makes it possible to squeeze out the particles that are present in a particular case, and thereby to maintain a high level of functional reliability. Moreover, in accordance with one advantageous embodiment of the present invention, the delivery line feeds into a return section which leads back to the material feed space and is preferably in the form of a bioreactor. The return section may have a heating means disposed therein which heats the material being conveyed. In order to prolong the residence time, the return section may have an extension section disposed therein which is preferably arranged in a meandering pattern.

Moreover, a pipeline leading to a processing station may be connected on the outside of the perforated lateral cylinder wall. The useful substances forced out through the perforations can be delivered to the processing station through this pipeline. Thus, the pump is provided with the function of a two-phase pump.

The device of the present invention is particularly suitable for carrying out a method for conveying mixtures of substances containing different components, at least one of the mixture components predominantly having a viscous consistency and at least one other mixture component predominantly having a solid, particle-like consistency. In accordance with the present invention, the mixture of substances is forced into a compression chamber while pressure is being built up. In the process, the mixture components predominantly having a viscous consistency and the mixture components predominantly having a solid, particle-like consistency are separated by the pressure developed in the compression chamber, thereby producing different flows of material. The division into different material flows is preferably accomplished by the fact that the mixture components predominantly having a viscous consistency are forced by the pressure out of the compression chamber and into a first delivery path through relief openings in a boundary wall, and that the mixture components predominantly having a solid, particle-like consistency are forced out of the compression chamber and into a second delivery path after a closure member is opened. The opening of the closure member is conveniently triggered when the pressure in the compression chamber exceeds a predetermined limit value. Advantageously, during a stroke of the piston, the predominantly viscous components of the mixture are forced through perforations in the cylinder wall while the closure member is in a closed position, while the predominantly particle-like, solid components of the mixture are forced into a delivery line downstream of the cylinder after the closure member is opened.

The device illustrated in the drawing is designed for preparing and conveying thick matter containing a liquid or pasty useful component and solid foreign components. As is typical of a single-piston pump, the device includes a plunger-like delivery piston 12 which is coupled to a hydraulic piston 11 of a hydraulic cylinder 10, a material feed space 16 which can be charged with thick matter via a feeding duct 14, a delivery cylinder 20 which is connected to material feed space 16 on the inlet side and to a delivery line 18 on the outlet side, and further includes a gate-like closure member 22 which is located on the outlet side of delivery cylinder 20 and which is movable between a closed position and an open position in a direction transverse to the delivery cylinder. Lateral cylinder wall 24 of delivery cylinder 20 has perforations 26 which are in the form of a grid of holes and which, on the outside of lateral cylinder wall 24, open into a collecting duct 28. A pressure sensor 42 may be included in the delivery cylinder 20 upstream of the closure member 22. In the exemplary embodiment shown, the material is supplied to feeding duct 14 via a hopper 30 and a screw conveyor 32.

In a device of this type, the sequence of a pumping cycle is as follows:

a) At the beginning of the cycle (see FIG. 1), delivery piston 12 is in a position where it is retracted into hydraulic cylinder 10. Material feed space 16 is filled via feeding duct 14 to a level above the piston diameter, while closure member 22 is in a closed position.

b) Then, hydraulic piston 11 and delivery piston 12 together begin to move toward closure member 22, causing the material in the material feed space to be pushed into delivery cylinder 20. A pressure P builds up in delivery cylinder 20, causing liquid and pasty components to be forced out through perforations 26 in lateral cylinder wall 24. At the same time, the passing delivery piston 12 cleans the inner surface of lateral cylinder wall 24 of filter cake. In the material remaining in delivery cylinder 20, the pressure increases to a predetermined limit pressure $P_{limit}$, which can be adjusted for each particular product. The limit pressure may, for example, be selected such that packaging containers present in the material being conveyed will burst and release their contents. The useful material fraction that is forced through perforations 26 flows into collecting duct 28 from where it is fed to a subsequent processing stage.

c) Once limit pressure $P_{limit}$ is reached, it is maintained for a short period of time.

d) Then, closure member 22 opens. This causes the pressure to decrease, thereby allowing delivery piston 12 to move further to its end position within delivery cylinder 20. The foreign fraction still present in delivery cylinder 20 is moved by delivery piston 12 into delivery line 18 for further processing.

e) Closure member 22 returns to its closed position.

f) Hydraulic piston 11 and delivery piston 12 return together to their original position. At the same, material feed space 16 is refilled via feeding duct 14.

The sequences of motion of delivery piston 12 and of closure member 22 are controlled by a control unit 40 in a coupled fashion in the manner of a sequence control system by means of suitable drive units.

The procedure described can be repeated several times, depending on the raw material to he processed. In the case of biogenic substances, it may be useful to interpose a bioreactor in the form of a hydrolysis stage. To this end, a return section 34 leading back to feeding duct 14 is used which may include a meandering extension section 36, depending on the desired residence time. The return section may have a heating means 44 disposed therein which beats the material being conveyed.

Figure 2C:
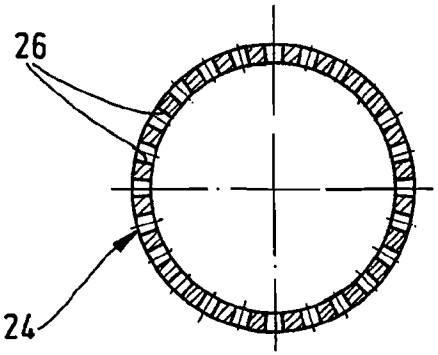
FIGS. 2*a* through *c* are, respectively, a side view, a longitudinal sectional view, and a cross-sectional view of the perforated lateral wall of the delivery cylinder.
Figure 2B:
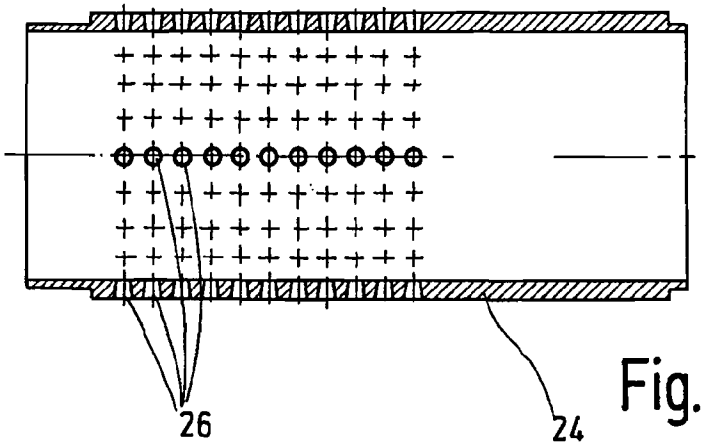
Figure 2A:
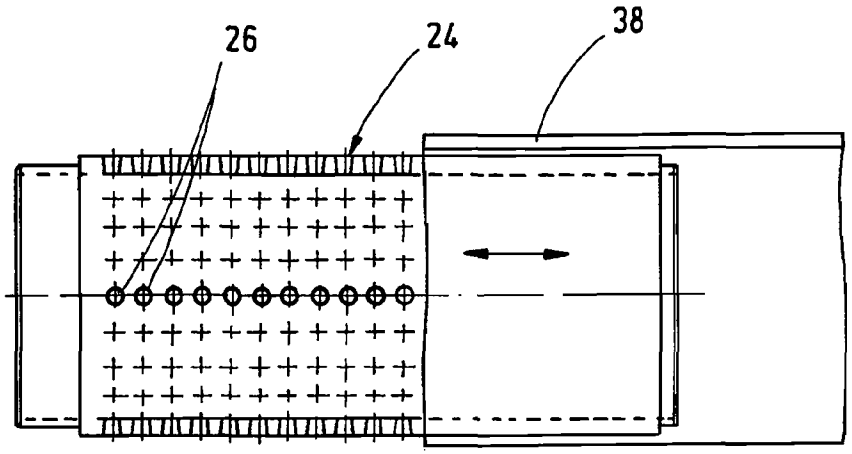
Figure 3:
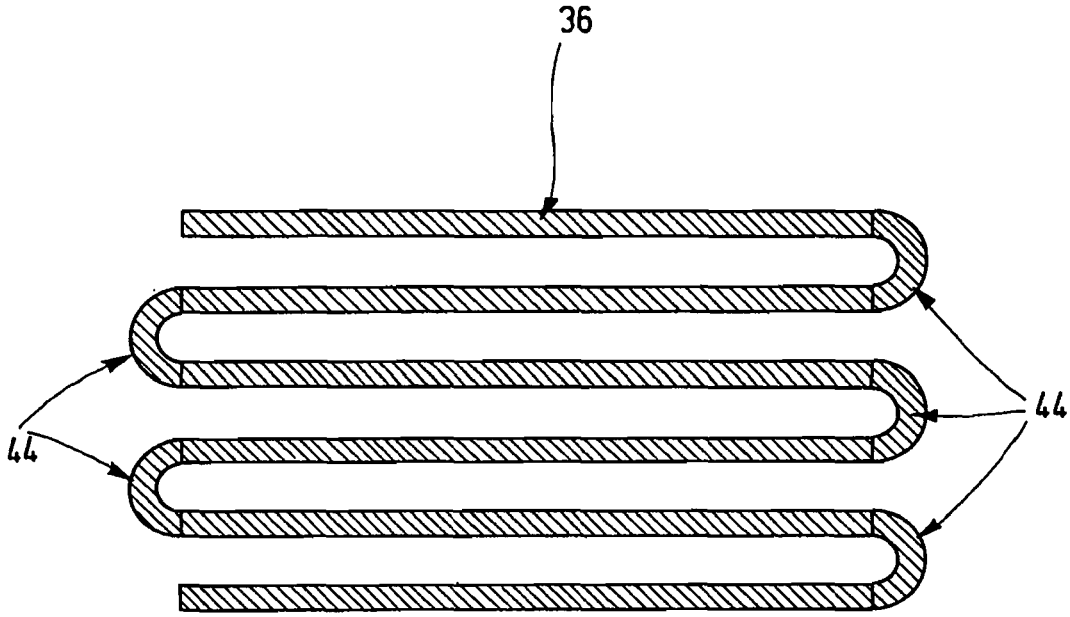
FIG. 3 is a view showing an extension section which is arranged in a meandering pattern and is intended to be integrated into the return section of the pump circuit of FIG. 1.

As can be seen from FIGS. 1 and 2*a*, perforated lateral cylinder wall 24 is surrounded by a tubular slide 38, which is movable relative to lateral cylinder wall 24 between a closed position, in which perforations 26 are sealed, and an open position, in which the perforations are left open. In the advantageous embodiment shown in FIG. 2*a*, the lateral cylinder wall is perforated over about half its length, while the slide has a closed shell and is moved by half the length of the lateral cylinder wall from the open position to the closed position.

In the embodiment illustrated. in FIG. 1, slide 38 has a grid of holes and closed areas therebetween, said grid being complementary to the grid of holes of the lateral cylinder wall. In this case, it is possible for the slide to be moved or rotated between the open position and the closed position in an axial or circumferential direction with respect to the lateral cylinder wall by half the grid spacing of the grid of holes. This results in a relatively small rotational or translational movement of slide 38 as compared to the embodiment of FIG. 2*a*. FIG. 1 indicates that the slide is also controlled by control unit 40. To this end, control unit 40 provides a sequence control system for controlling the drive unit 10, 11 of delrvery piston 12, the drive unit 46 of closure member 22, and the drive unit 48 of slide 38.

An embodiment of the invention is summarized as follows: The present invention relates to a device for conveying thick matter. The device includes a delivery cylinder 20, a material feed space 16 connected to the inlet side of delivery cylinder 20, a delivery line 18 connected to the outlet side of delivery cylinder 20, a delivery piston 12 which is reciprocatable through material feed space 16 and delivery cylinder 20, and further includes a closure member 22 which is located at the outlet of delivery cylinder 20 or in delivery line 18 and is movable between an open position and a closed position. In order to allow the foreign substances contained in the flow of thick material to be separated from said material flow before the actual processing step for the useful substances, it is proposed, in accordance with the present invention, that delivery cylinder 20 be perforated at least over a portion of its lateral wall 24. With these measures, a device is obtained which combines the features of a thick matter pump, a sieve and a press.

What is claimed is:

1. A device for conveying a mixture of substances including at least one mixture component predominantly having a viscous consistency and at least one mixture component predominantly having a solid, particle-like consistency, the device comprising:

a delivery cylinder having perforations over a portion of a lateral wall thereof and configured to separate, through the perforations, at least one of the mixture components from the mixture of substances, the delivery cylinder being connected, via a pipeline provided on an outside of the perforated lateral cylinder wall, to a processing station for the separated at least one mixture component;

a material feed space connected to an inlet side of the delivery cylinder;

a delivery line connected to an outlet side of the delivery cylinder, the delivery line being configured to feed into a return section leading back to the material feed space, the delivery line having a fond of a bioreactor;

a delivery piston reciprocatable through the material feed space and the delivery cylinder; and a closure member disposed at the outlet side of the delivery cylinder or in the delivery line and movable between an open position and a closed position.

2. The device as recited in claim 1 wherein the delivery cylinder is in communication with a collecting duct on the outside of the perforated lateral cylinder wall.

3. The device as recited in claim 2 wherein the perforations of the lateral cylinder wall are in a form of a grid of holes.

4. The device as recited in claim 1 wherein the portion of the lateral cylinder wall is swept by the delivery piston during reciprocation.

5. The device as recited in claim 1 wherein a cross-sectional area of the perforations is smaller on an inside than on an outside of the lateral cylinder wall.

6. The device as recited in claim 1 wherein the lateral cylinder wall includes a material that is hardened on an inner side thereof.

7. The device as recited in claim 1 further comprising a slide disposed in an area of the lateral cylinder wall and movable relative to the lateral cylinder wall between a closed position and an open position, the perforations being sealed when the slide is in the closed position and the perforations being open when the slide in is the open position.

8. The device as recited in claim 7 wherein the slide surrounds the portion of the lateral cylinder wall in a manner of a tube.

9. The device as recited in claim 7 further comprising a control unit configured for coupled control of at least one of a drive mechanism configured to move the delivery piston, a drive mechanism configured to move the closure member, and a drive mechanism configured to move the slide.

10. The device as recited in claim 9 wherein the control unit includes a sequence control system for controlling the respective drive mechanism of at least one of the delivery piston, the closure member, and the slide.

11. The device as recited in claim 9 wherein the control unit is configured to activate the closure member to perform a closing movement in response to displacement signals produced by the delivery piston.

12. The device as recited in claim 9 further comprising a pressure sensor disposed at least one of in the delivery line and upstream of the closure member in the delivery cylinder and wherein the control unit is configured, in response to an output signal of the pressure sensor, to trigger the closure member to perform an opening movement.

13. The device as recited in claim 9 wherein the slide includes a drive mechanism controllable by the control unit.

14. The device as recited in claim 7 wherein the slide is movable axially relative to the lateral cylinder wall.

15. The device as recited in claim 14 wherein the portion of the lateral cylinder wall extends over at most half of a length of the lateral cylinder wall, and wherein the slide includes a closed shell and is movable by half of the length of the lateral cylinder wall from the open position to the closed position.

16. The device as recited in claim 7 wherein the perforations of the lateral cylinder wall are in a form of a first grid of holes, and wherein the slide has a second grid of holes and closed areas therebetween, the second grid of holes being complementary to the first grid of holes.

17. The device as recited in claim 16 wherein the slide is at least one of movable and rotatable between the open position and the closed position respectively in an axial or circumferential direction with respect to the lateral cylinder wall by half a grid spacing of the first grid of holes.

18. The device as recited in claim 9 wherein the control unit is configured to respond to displacement signals of the delivery piston so as to trigger the slide to perform an opening movement as the delivery piston moves into the delivery cylinder.

19. The device as recited in claim 9 further comprising a pressure sensor disposed at least one of in the delivery line and upstream of the closure member in the delivery cylinder, and wherein the control unit is configured, in response to an output signal of the pressure sensor, to trigger the slide to perform a closing movement when a pressure exceeds a predetermined threshold.

20. The device as recited in claim 1 further comprising a cleaning device configured to apply at least one of compressed air and pressurized water to the perforations.

21. The device as recited in claim 1 further comprising a heating device disposed in the return section and configured to heat the material conveyed in the return section.

22. The device as recited in claim 1 further comprising an extension section disposed in the return section and having a meandering pattern.

* * * * *